US009685728B2

(12) United States Patent
Yao et al.

(10) Patent No.: US 9,685,728 B2
(45) Date of Patent: Jun. 20, 2017

(54) ELECTRICAL CONNECTOR HAVING WATERPROOF FILM

(71) Applicant: FOXCONN INTERCONNECT TECHNOLOGY LIMITED, Grand Cayman (KY)

(72) Inventors: Tao Yao, Huaian (CN); Jing-Jie Guo, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/241,039

(22) Filed: Aug. 18, 2016

(65) Prior Publication Data

US 2017/0054246 A1 Feb. 23, 2017

(30) Foreign Application Priority Data

Aug. 19, 2015 (CN) ..... 2015 1 0509797

(51) Int. Cl.

| | |
|---|---|
| ***H01R 13/52*** | (2006.01) |
| ***H01R 13/6581*** | (2011.01) |
| ***H01R 13/405*** | (2006.01) |
| ***H01R 13/502*** | (2006.01) |
| ***H01R 24/64*** | (2011.01) |
| *H01R 107/00* | (2006.01) |

(52) U.S. Cl.

CPC ..... *H01R 13/521* (2013.01); *H01R 13/405* (2013.01); *H01R 13/502* (2013.01); *H01R 13/6581* (2013.01); *H01R 24/64* (2013.01); *H01R 2107/00* (2013.01)

(58) Field of Classification Search

CPC ..... H01R 13/521; H01R 13/502; H01R 13/6581; H01R 13/405; H01R 24/64; H01R 2107/00

USPC ..... 439/519–521, 607.01

See application file for complete search history.

(56) References Cited

U.S. PATENT DOCUMENTS

| | | | | |
|---|---|---|---|---|
| 4,747,783 | A * | 5/1988 | Bellamy | H01R 13/03 200/268 |
| 7,467,960 | B1 * | 12/2008 | Harlan | H01R 13/03 439/181 |
| 2013/0174410 | A1 | 7/2013 | Stevens et al. | |
| 2015/0060110 | A1 | 3/2015 | Merz et al. | |
| 2016/0164217 | A1 | 6/2016 | Lee | |

* cited by examiner

*Primary Examiner* — Khiem Nguyen

(74) *Attorney, Agent, or Firm* — Wei Te Chung; Ming Chieh Chang

(57) ABSTRACT

An electrical connector includes: an insulative housing having a rear base portion and a front tongue portion, said tongue portion being formed with a platform connected with the base portion; a number of terminals arranged at the tongue portion, each terminal comprising a conductive portion formed with a contacting portion for contacting with a mating connector, and a soldering portion extending outwardly of the insulative housing; at least one waterproof film extending rearwardly up to the platform; and a shielding shell enclosing the insulative housing; wherein the conductive portions of the terminals are exposed on the tongue portion to form at least one conductive region on the tongue portion covered by the at least one waterproof film.

7 Claims, 5 Drawing Sheets

ELECTRICAL CONNECTOR HAVING WATERPROOF FILM

BACKGROUND OF THE INVENTION

1. Field of the Invention

The present invention relates to an electrical connector, and more particularly to a USB (Universal Serial Bus) connector adapted for being normally and reversely mating with a mating connector and loading a card.

2. Description of Related Art

U.S. Patent Application Publication No. 2016/0164217, published on Jun. 9, 2016, discloses a USB socket connector including an insulative housing defining a plurality of passageways, a plurality of terminals accommodated in the passageways, and a shell enclosing the insulative housing. Each terminal has a contacting portion exposed on housing tongue portion. Glue is filled at a rear face of the insulative housing and an inner wall of the shell. Tiny slits may exist between the passageway and the terminal contacting portion.

U.S. Patent Application Publication No. 2015/0060110, published on Mar. 5, 2015, discloses a method for shielding electronic components from moisture. In one embodiment a printed circuit board having plug side connector is conformally coated while a flex circuit having receptacle side connector is not conformally coated and therefore exposed solder leads remain. To resolve the exposure issue, a seal is used around the connector. Besides, when receptacle side connector is coupled with plug side connector the mechanical friction between the connectors can be enough to remove a conformal coating from a contacted portion of plug side connector 404, allowing electrical communication between the connectors.

An improved USB socket connector having improved waterproof function is desired.

SUMMARY OF THE INVENTION

Accordingly, an object of the present invention is to provide an electrical connector having a waterproof film covering conductive regions of the tongue portion to perform waterproof function.

In order to achieve the object set forth, an electrical connector includes: an insulative housing having a rear base portion and a front tongue portion, said tongue portion being formed with a platform connected with the base portion; a plurality of terminals arranged at the tongue portion, each terminal comprising a conductive portion formed with a contacting portion for contacting with a mating connector, and a soldering portion extending outwardly of the insulative housing; at least one waterproof film extending rearwardly up to the platform; and a shielding shell enclosing the insulative housing; wherein said conductive portions of the terminals are exposed on the tongue portion to form at least one conductive region on the tongue portion covered by the at least one waterproof film.

The tongue portion is formed with a plurality of passageways accommodating with the terminals. Each passageway has a dimension larger than that of the terminal to form a tiny slit between the terminal and the passageways. The waterproof films cover the conductive regions, to cover the tiny slits, to thereby prevent leaking.

Other objects, advantages and novel features of the invention will become more apparent from the following detailed description when taken in conjunction with the accompanying drawings.

DETAILED DESCRIPTION OF THE PREFERRED EMBODIMENT

Figure 1:
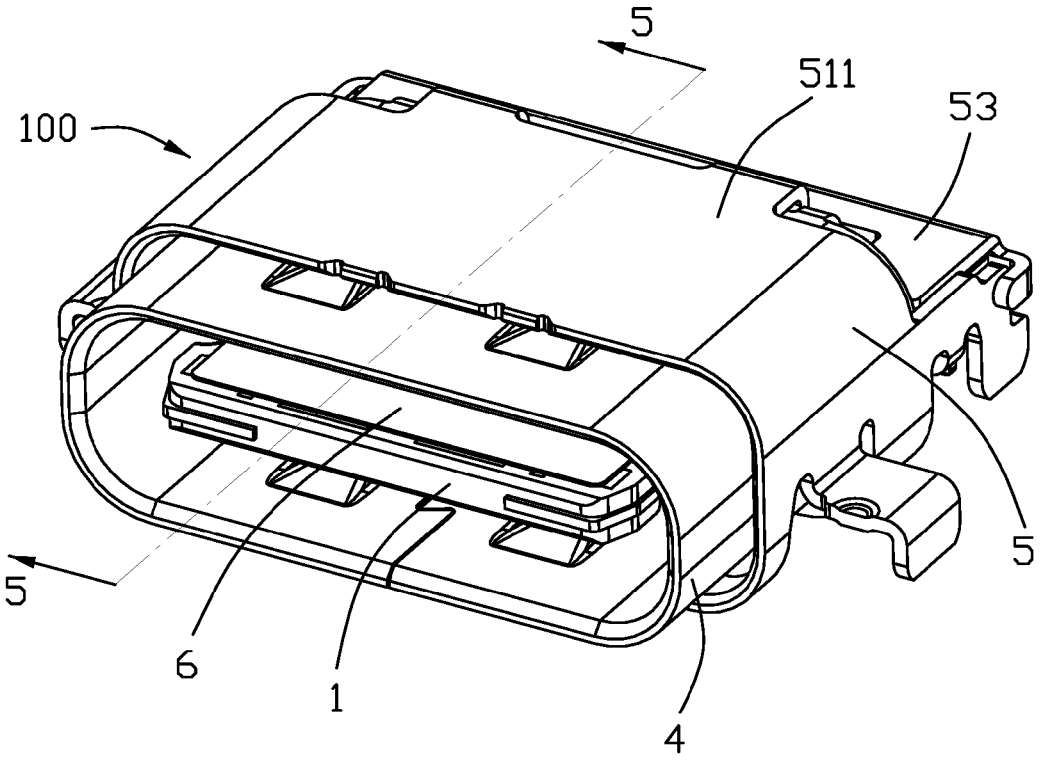
FIG. 1 is an assembled perspective view showing an electrical connector in accordance with the present invention.
Figure 2:
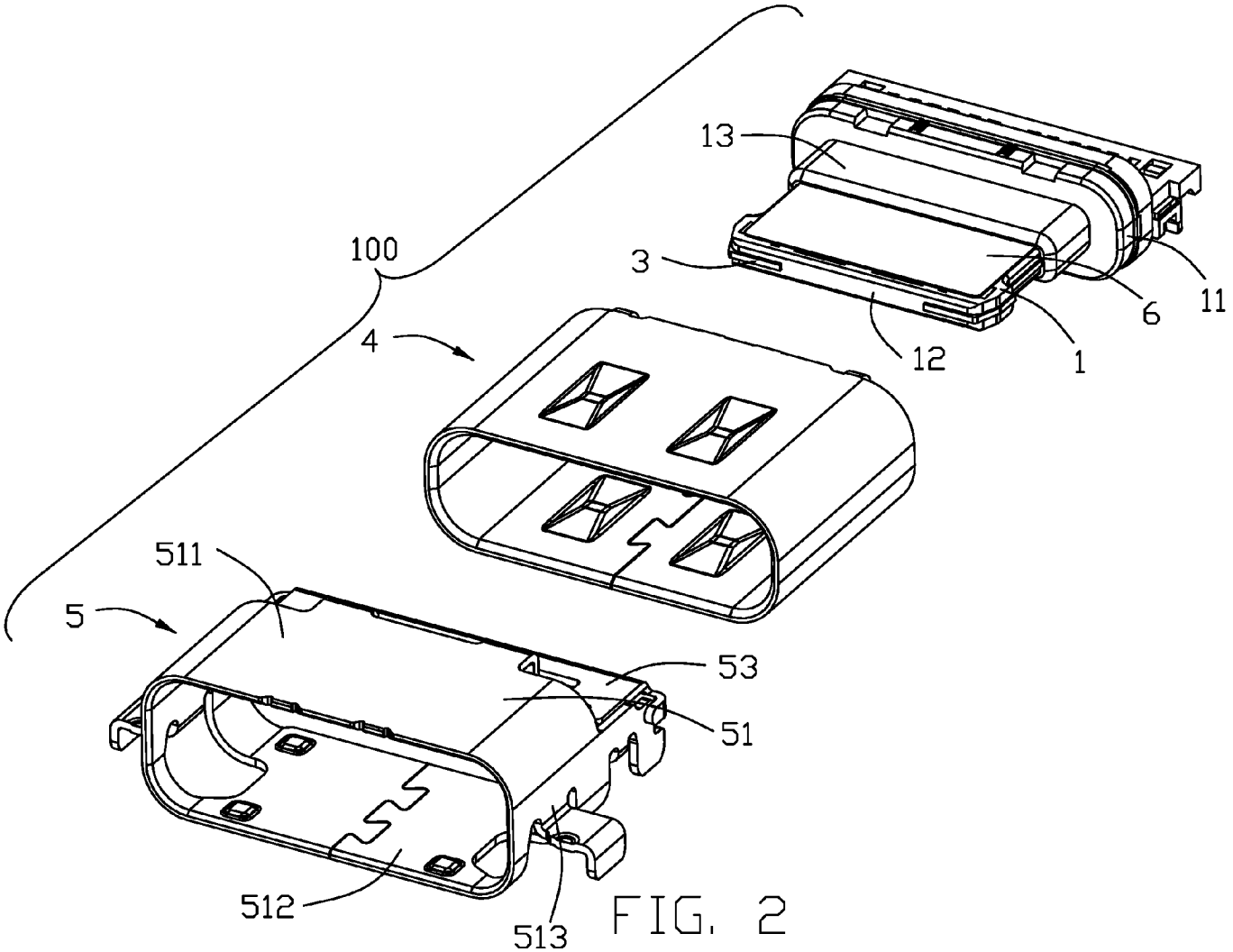
FIG. 2 is a partly exploded perspective view showing the electrical connector.
Figure 3:
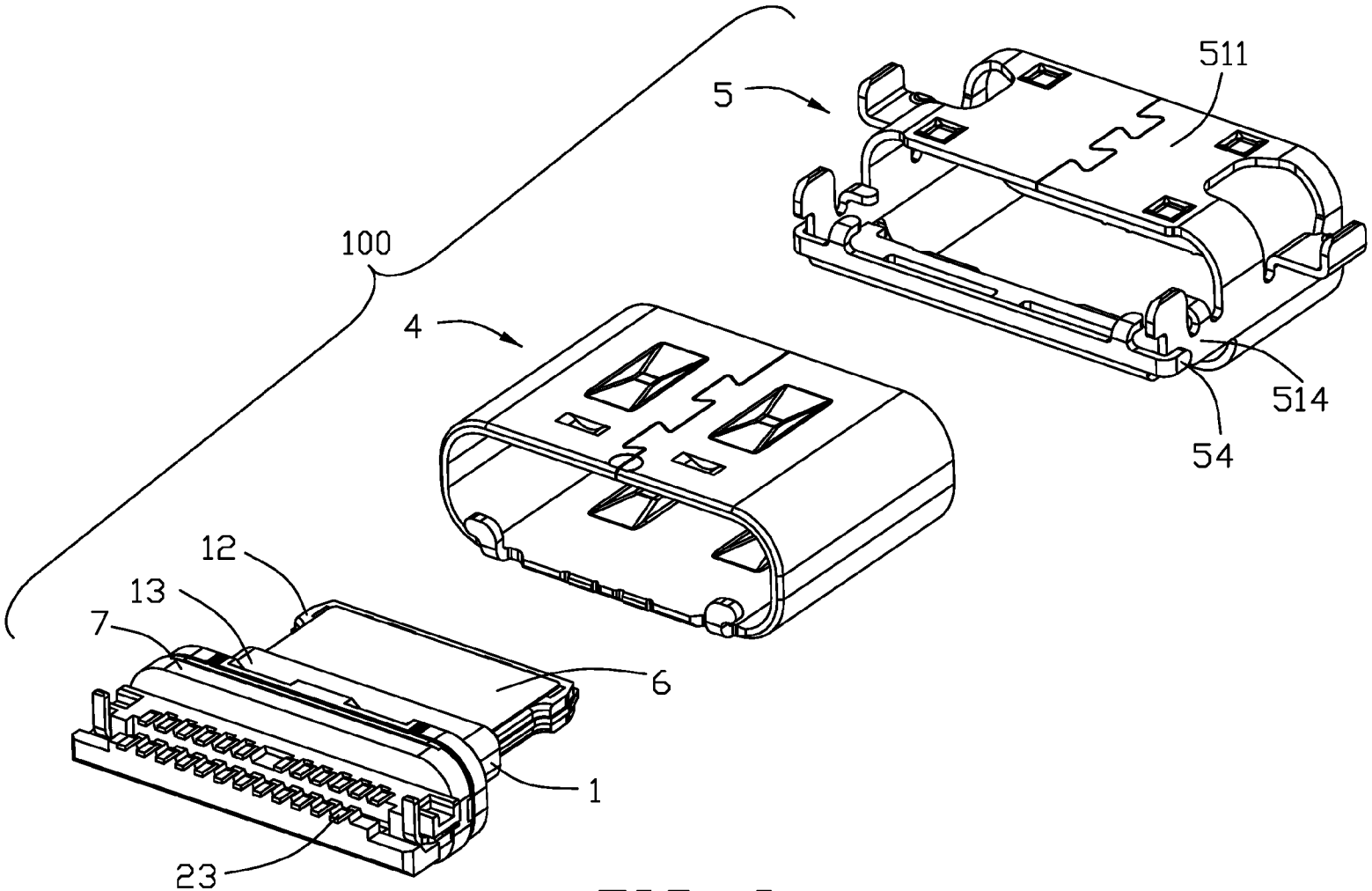
FIG. 3 is another view similar to FIG. 2, taken from another aspect.
Figure 4:
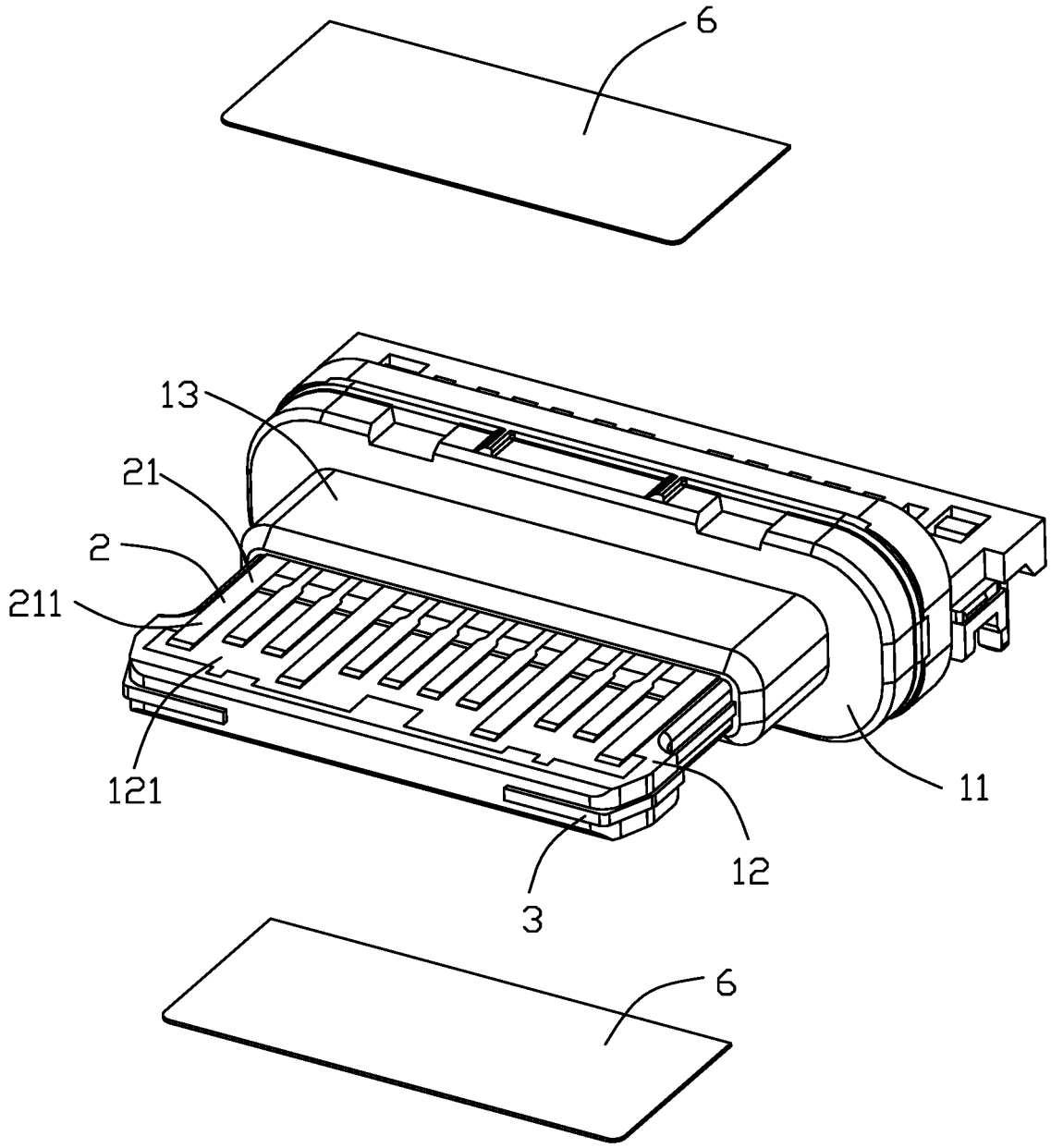
FIG. 4 is a waterproof film separated from the insulative housing.
Figure 5:
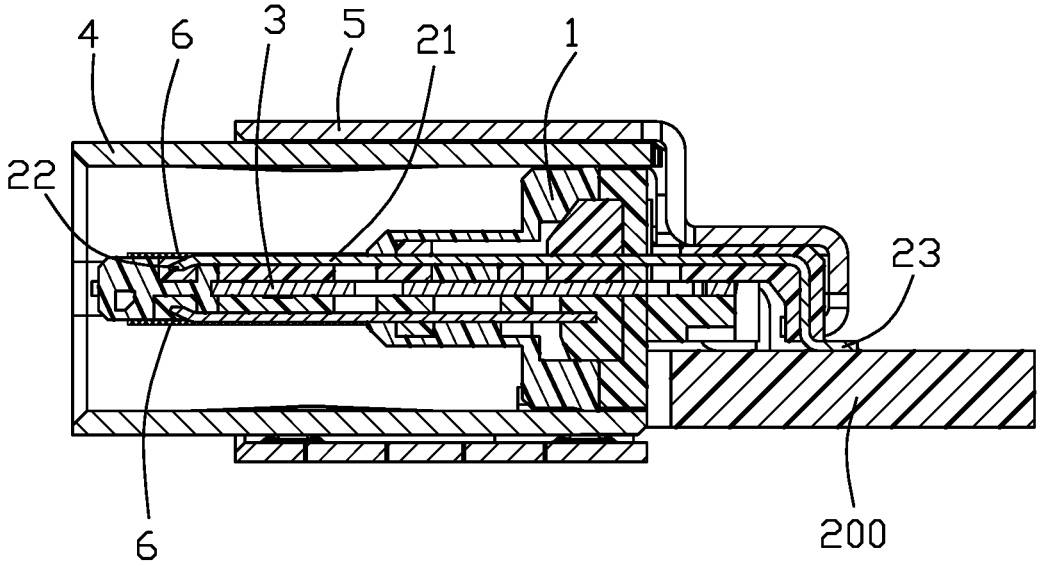
FIG. 5 is a cross-sectional view of the electrical connector along line 5-5 in FIG. 1 soldered on a board.

Reference will now be made in detail to the preferred embodiment of the present invention. Referring to FIGS. 1-5, an electrical connector 100 comprises an insulative housing 1, two rows of reverse-symmetrically arranged terminals 2, a pair of waterproof films 6, a metal plate 3 between two rows of terminals 2, an inner shell 4, a shielding shell 5 enclosing the insulative housing 1, and a waterproof portion 7.

The insulative housing 1 has a base portion 11 and a tongue portion 12 extending forwardly from the base portion 11. The tongue portion 12 is formed with a platform 13 connected with the base portion 11.

Each terminal 2 comprises a conductive portion or contacting section 21 formed with a contacting portion 211 contacting with a mating connector, an embedded portion 22 formed in front of the contacting portion 211 and a soldering portion 23 extending outwardly from the insulative housing 1.

The shielding shell 5 includes a main portion 51, a rear portion 53 behind the main portion 51, and a pair of beams 54 bent from opposite sides of the rear portion 53. The main portion 51 includes an upper wall 511, a lower wall 512, a pair of side walls 513, and a pair of side portions 514 extending rearwardly from the side walls 513 till the rear portion 53.

In assembling of the electrical connector 100, two rows of terminals 2 are arranged at opposite faces of the tongue portion 12, with the embedded portions 22 embedded in the tongue portion 12. The conductive portions 21 of the terminals 2 are exposed on opposite faces of the tongue portion 12 to form a pair of conductive regions 121 on the tongue portion 12. The pair of conductive regions 121 are covered by the pair of waterproof films 6. The waterproof film 6 is more close to a front end of the tongue portion 12 than the embedded portion 22, and extends rearwardly till the platform 13. The conductive portions 21 in each row of the terminals 2 are covered by the waterproof film 6 along a transverse direction.

The insulative housing 1 together with the terminals 2 and the waterproof films 6 are enclosed in the inner shell 4. Waterproof material is disposed at a rear portion of the insulative housing 1 to form the waterproof portion 7. The soldering portions 23 are exposed outside of the waterproof portion 7. The shielding shell 5 is mounted onto the inner shell 4. The inner shell 4 extends forwardly through the shielding shell 5. The pair of side portions 514 are respectively bent to abut against the pair of beams 54.

The tongue portion 12 is formed with a plurality of passageways (not shown) accommodating with the terminals 2. Each passageway has a dimension larger than that of the terminal 2 to form a tiny slit (not shown) between the terminal 2 and the passageways. It is easy to leak through the tiny slits. The waterproof films 6 cover the conductive regions 121, to cover the tiny slits, to thereby prevent leaking through the tiny slits. The electrical conductivity of the conductive regions 121 will not be reduced by the waterproof films 6.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a rear base portion and a front tongue portion, said tongue portion being formed with a platform connected with the base portion;

a plurality of terminals arranged at the tongue portion, each terminal comprising a conductive portion formed with a contacting portion for contacting with a mating connector, and a soldering portion extending outwardly of the insulative housing;

at least one waterproof film extending rearwardly up to the platform; and a shielding shell enclosing the insulative housing; wherein said conductive portions of the terminals are exposed on the tongue portion to form at least one conductive region on the tongue portion covered by the at least one waterproof film.

2. The electrical connector as claimed in claim 1, wherein said tongue portion has opposite side faces, said plurality of terminals comprise two rows, and said conductive portions are arranged into two rows respectively exposed at the opposite faces of the tongue portion to form a pair of said conductive regions respectively covered by a pair of said waterproof films.

3. The electrical connector as claimed in claim 2, wherein each terminal includes an embedded portion formed in front of the contacting portion and embedded in the tongue portion, and the waterproof film is closer to a front end of the tongue portion than the embedded portion.

4. The electrical connector as claimed in claim 2, wherein the conductive portions of each row of the terminals are covered by the waterproof film along a transverse direction.

5. An electrical connector comprising:

an insulative housing forming a tongue portion having opposite surfaces in a vertical direction;

a metallic shielding shell enclosing said housing;

a plurality of contacts retained in the housing via an insert-molding process, each of said contacts including a contacting section exposed upon the corresponding surface; and a waterproof film applied upon the surfaces; wherein said waterproof film is thin enough for maintaining original electrical performance and is rigid enough for resisting scraping due to mating.

6. The electrical connector as claimed in claim 5, wherein said waterproof film fills minor gaps between the contacting sections and the tongue portion around the corresponding surface.

7. The electrical connector as claimed in claim 6, wherein said housing further includes a raised platform intimately linked behind the tongue portion in a front-to-back direction perpendicular to the vertical direction, and said waterproof film is terminated at said platform.

* * * * *